US009803885B2

(12) United States Patent
Komai et al.

(10) Patent No.: US 9,803,885 B2
(45) Date of Patent: Oct. 31, 2017

(54) DRIVE MECHANISM FOR MOVABLE MEMBER OF AIR CONDITIONER

(71) Applicant: DAIKIN INDUSTRIES, LTD., Osaka-shi, Osaka (JP)

(72) Inventors: Yousuke Komai, Kusatsu (JP); Tetsuji Inoue, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 2 days.

(21) Appl. No.: 14/906,894

(22) PCT Filed: Jul. 15, 2014

(86) PCT No.: PCT/JP2014/068796

§ 371 (c)(1),
(2) Date: Jan. 21, 2016

(87) PCT Pub. No.: WO2015/012157

PCT Pub. Date: Jan. 29, 2015

(65) Prior Publication Data

US 2016/0153679 A1 Jun. 2, 2016

(30) Foreign Application Priority Data

Jul. 24, 2013 (JP) ..... 2013-153305

(51) Int. Cl.
*F24F 13/10* (2006.01)
*F24F 13/14* (2006.01)
(Continued)

(52) U.S. Cl.
CPC ..... *F24F 13/10* (2013.01); *F24F 1/0011* (2013.01); *F24F 13/1426* (2013.01); *F24F 11/0078* (2013.01); *F24F 2013/1473* (2013.01)

(58) Field of Classification Search
CPC ..... F24F 13/10; F24F 1/0011; F24F 13/1426; F24F 11/0078; F24F 2013/1473
See application file for complete search history.

(56) References Cited

U.S. PATENT DOCUMENTS

2001/0052240 A1* 12/2001 Kim ..... F24F 1/0011 62/409
2004/0031276 A1* 2/2004 Cho ..... F25D 17/045 62/186
2014/0199937 A1 7/2014 Shang et al.

FOREIGN PATENT DOCUMENTS

JP 63-32254 U 3/1988
JP 5-32860 U 4/1993
(Continued)

OTHER PUBLICATIONS

International Search Report of corresponding PCT Application No. PCT/JP2014/068796 dated Oct. 21, 2014.
(Continued)

*Primary Examiner* — Victor MacArthur
(74) *Attorney, Agent, or Firm* — Global IP Counselors, LLP

(57) ABSTRACT

A drive mechanism is configured to drive a movable member of an air conditioner. The drive mechanism includes a motor, a pinion secured to a rotating shaft of the motor, a rack meshing with the pinion, and a guide. The rack has a driven portion directly or indirectly linked to the movable member. The guide is arranged to guide the rack so that the driven portion can travel in a curved path. The guide has a tube part through which the rack passes.

15 Claims, 4 Drawing Sheets

(51) Int. Cl.
*F24F 1/00* (2011.01)
*F24F 11/00* (2006.01)

(56) References Cited

FOREIGN PATENT DOCUMENTS

| | | | |
|---|---|---|---|
| JP | 2000-74476 | A | 3/2000 |
| WO | 2013/023569 | A1 | 2/2013 |

OTHER PUBLICATIONS

International Preliminary Report of corresponding PCT Application No. PCT/JP2014/068796 dated Feb. 4, 2016.
European Search Report of corresponding EP Application No. 14 82 9906.8 dated Aug. 5, 2016.

* cited by examiner

DRIVE MECHANISM FOR MOVABLE MEMBER OF AIR CONDITIONER

CROSS-REFERENCE TO RELATED APPLICATIONS

This U.S. National stage application claims priority under 35 U.S.C. §119(a) to Japanese Patent Application No. 2013-153305, filed in Japan on Jul. 24, 2013, the entire contents of which is hereby incorporated herein by reference.

TECHNICAL FIELD

The present invention relates to a drive device, and particularly relates to a drive mechanism for swinging the vertical vane of an air conditioner.

BACKGROUND ART

In the past, mechanisms in which a first link is secured to a rotating shaft of a motor and a second link is tunably connected to the first link, such as that disclosed Japanese Laid-open Patent Application No. 2000-74476, have become common as drive mechanisms for swinging a vertical airflow direction adjustment vane of an air conditioner (also common is the feature of placing an intermediate link between the first link and the second link in order to stabilize the swinging of the vertical airflow direction adjustment vane).

SUMMARY

Technical Problem

To increase the swinging width of the vertical airflow direction adjustment vane in the drive mechanism of Japanese Laid-open Patent Application No. 2000-74476, the distance "from the motor shaft to the linking point of the first link and second link" must be increased, and the torque required by the motor increases accordingly, which leads to an increase in size of the motor.

Conversely, when the purpose is to reduce the size of the motor, this distance must be reduced, and the swinging width of the vertical airflow direction adjustment vane is limited.

An object of the present invention is to provide a drive mechanism for a movable member of an air conditioner in which the motor can be reduced in size while a conventional swinging width is maintained for the vertical airflow direction adjustment vane.

Solution to Problem

A drive mechanism according to a first aspect of the present invention is a drive mechanism for driving a movable member of an air conditioner, the drive mechanism comprising a motor, a pinion, a rack, and a guide. The pinion is secured to a rotating shaft of the motor. The rack has a driven portion directly or indirectly linked to the movable member, and the rack meshes with the pinion. The guide guides the rack so that the driven portion can travel in a curved path.

In this drive mechanism, a rack and pinion mechanism converts rotational motion to reciprocating linear motion, wherein swinging motion is extracted directly from the rack and pinion mechanism by making the rack travel in a curved path, and the conventional member for converting the linear motion of the rack to swinging motion can therefore be omitted.

Because the swinging amount of the movable member can be adjusted according to the rotating amount of the pinion, the motor torque can be reduced to a greater extent than with a configuration in which the swinging amount is adjusted by the distance "from the motor shaft to the linking point of the first link and the second link," as has been done in the past.

A drive mechanism according to a second aspect of the present invention is the drive mechanism according to the first aspect, wherein the guide causes the driven portion to travel in a curved path by allowing the driven portion to oscillate within a predetermined range in a direction intersecting the longitudinal direction of the driven portion.

In conventional practice, a rack and pinion is utilized on the premise that the rack is made to reciprocate linearly; therefore, the rack and pinion does not have the function of making the rack swing. However, in this drive mechanism, the swinging motion of the rack can be directly extracted from the rack and pinion because the driven portion travels in a curved path, due to the guide allowing the driven portion of the rack to oscillate within a predetermined range in a direction intersecting the longitudinal direction of the driven portion. Therefore, fewer components are required than in a conventional link structure.

A drive mechanism according to a third aspect of the present invention is the drive mechanism according to the first or second aspect, wherein the curved path is an arcuate path.

A drive mechanism according to a fourth aspect of the present invention is the drive mechanism according to the third aspect, wherein the radius of the arc traveled by the distal end of the driven portion is 100 mm or less.

A drive mechanism according to a fifth aspect of the present invention is the drive mechanism according to any of the first through fourth aspects, wherein the ratio (h/L) of the displacement h of the distal end of the driven portion in the direction intersecting the longitudinal direction, relative to the movement distance L of the driven portion in the longitudinal direction, is within the range 0.15 to 0.25.

A drive mechanism according to a sixth aspect of the present invention is the drive mechanism according to the first aspect, wherein the guide has a tube part through which the rack passes. The rack has a protuberance that protrudes from a portion accommodated in the tube part toward the inner surface of the tube part.

In this drive mechanism, the clearance between the protuberance and the inner surface of the tube part determines the range that the driven portion of the rack can oscillate in the direction intersecting the longitudinal direction, and the necessary oscillation range can therefore be achieved by adjusting this clearance.

A drive mechanism according to a seventh aspect of the present invention is the drive mechanism according to the first aspect, wherein the guide has a tube part through which the rack passes. The rack has a flange from the distal end of the driven portion to the portion accommodated in the tube part, the flange being larger than the opening area of the tube part.

For example, when the drive mechanism is disposed in a portion of the air conditioner through which conditioned air flows, cold air will flow along the driven portion into the tube part of the guide. However, because entry of cold air into the tube part is hindered by the presence of the flange in this drive device, events such as condensation on the inner side of the tube part are prevented.

A drive mechanism according to an eighth aspect of the present invention is the drive mechanism according to the first aspect, further comprising a gearbox for accommodating the meshing portion of the rack and pinion. The guide has a tube part communicated with the interior of the gear box, the rack passing through the tube part. The rack further has, in the area on the side opposite the pinion across the portion meshing with the pinion, a guide groove in which a gap between opposing end surfaces is greater than the movement distance of the rack. The gearbox has a rib that enters the guide groove of the rack when the meshing portion of the rack and pinion is accommodated.

In this rack and pinion, the movement distance of the rack is adjusted by controlling the rotation amount of the pinion, but mechanical restrictions are needed in order to prevent the rack falling out due to the motor overrunning, or other such adverse events. In this drive mechanism, the rib on the gearbox side remains in the guide groove of the rack even in the unfortunate event that the motor overruns, and the rib and the end of the guide groove therefore come into contact, preventing the rack from falling out.

Advantageous Effects of Invention

In the drive mechanism according to the first aspect of the present invention, a rack and pinion mechanism converts rotational motion to reciprocating linear motion, wherein swinging motion is extracted directly from the rack and pinion mechanism by making the rack travel in a curved path, and the conventional member for converting the linear motion of the rack to swinging motion can therefore be omitted. Because the swinging amount of the movable member can be adjusted according to the rotating amount of the pinion, the motor torque can be reduced more than with a configuration in which the swinging amount is adjusted by the distance "from the motor shaft to the linking point of the first link and the second link," as has been done in the past.

In the drive mechanism according to any of the second through fifth aspects of the present invention, the swinging motion of the rack can be directly extracted from the rack and pinion because the driven portion travels in a curved path, due to the guide allowing the driven portion of the rack to oscillate within a predetermined range in a direction intersecting the longitudinal direction of the driven portion. Therefore, fewer components are required than in a conventional link structure.

In the drive mechanism according to the sixth aspect of the present invention, the clearance between the protuberance and the inner surface of the tube part determines the range that the driven portion of the rack can oscillate in the direction intersecting the longitudinal direction, and the necessary oscillation range can therefore be achieved by adjusting this clearance.

In the drive mechanism according to the seventh aspect of the present invention, because entry of cold air into the tube part is hindered by the presence of the flange, events such as condensation on the inner side of the tube part are prevented.

In the drive mechanism according to the eighth aspect of the present invention, the rib on the gearbox side remains in the guide groove of the rack even in the unfortunate event that the motor overruns, and the rib and the end of the guide groove therefore come into contact, preventing the rack from falling out.

DESCRIPTION OF EMBODIMENTS

An embodiment of the present invention is described below with reference to the drawings. The following embodiment, which is a specific example of the present invention, does not limit the technical range of the present invention.

(1) Configuration of Air-conditioning Indoor Unit 10

Figure 1:
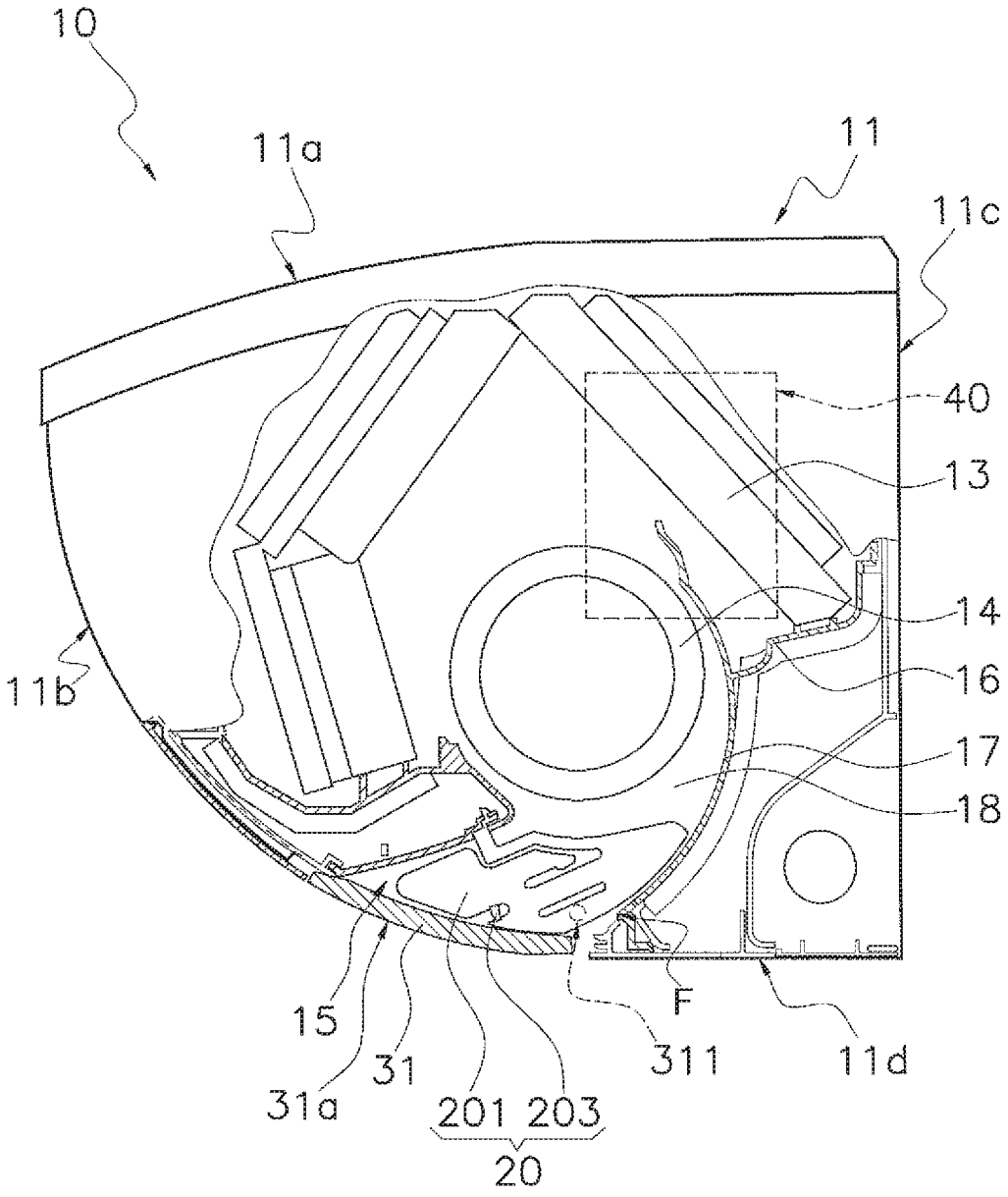
FIG. 1 is a cross-sectional view of an air-conditioning indoor unit 10 when stopped operation.

FIG. 1 is a cross-sectional view of the air-conditioning indoor unit 10 when stopped. In FIG. 1, the air-conditioning indoor unit 10 is a wall-mounted unit, equipped with a main body casing 11, an indoor heat exchanger 13, an indoor fan 14, a bottom frame 16, and a controller 40.

The main body casing 11 has a top surface part 11*a*, a front surface panel 11*b*, a back surface plate 11*c*, and a lower horizontal plate 11*d*, and the interior accommodates the indoor heat exchanger 13, the indoor fan 14, the bottom frame 16, and the controller 40.

The top surface part 11*a* is positioned in the upper part of the main body casing 11, and an intake port (not shown) is provided in the front part of the top surface part 11*a*.

The front surface panel 11*b* constitutes the front surface part of the indoor unit, and has a flat shape with no intake port. The front surface panel 11*b* is also turnably supported at the upper end on the top surface part 11*a*, and the front surface panel can operate as a hinge.

The indoor heat exchanger 13 and the indoor fan 14 are attached to the bottom frame 16. The indoor heat exchanger 13 conducts heat exchange with air passing through. In a side view, the indoor heat exchanger 13 has the shape of an upside-down V of which both ends are bent downward, underneath with the indoor fan 14 is positioned. The indoor fan 14, which is a cross-flow fan, blows the air taken in from the room back into the room after the air has passed over the indoor heat exchanger 13.

A blow-out port 15 is provided in the lower part of the main body casing 11. An upward-downward airflow direction adjustment vane 31 for varying the direction of blown air that is blown out from the blow-out port 15 is turnably attached to the blow-out port 15. The upward-downward airflow direction adjustment vane 31, driven by a motor (not shown), not only varies the direction of blown air, but can also open and close the blow-out port 15. The upward-downward airflow direction adjustment vane 31 can take on a plurality of orientations of different incline angles.

The blow-out port 15 is joined to the interior of the main body casing 11 by a blow-out channel 18. The blow-out channel 18 is formed from the blow-out port 15 along a scroll 17 of the bottom frame 16.

Indoor air is drawn into the indoor fan 14 through the intake port and the indoor heat exchanger 13 by the working of the indoor fan 14, and is blown by the indoor fan 14 through the blow-out channel 18 and out of the blow-out port 15.

Viewing the main body casing 11 from the front surface panel 11*b*, the controller 40 is positioned to the right of the indoor heat exchanger 13 and the indoor fan 14, and the controller controls the rotational speed of the indoor fan 14 and the actions of the upward-downward airflow direction adjustment vane 31.

Figure 2A:
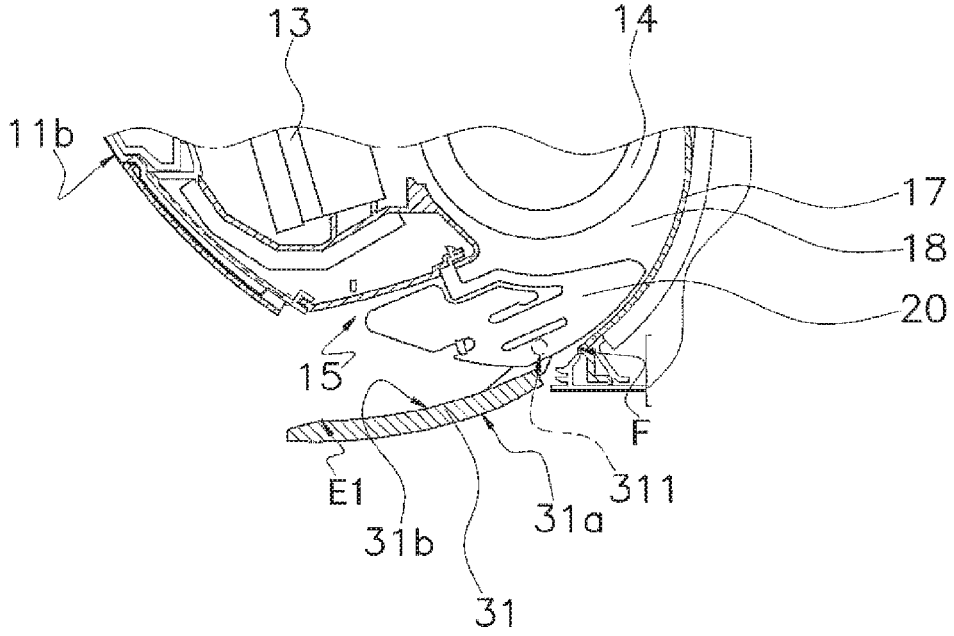
FIG. 2A is a partial cross-sectional view of the air-conditioning indoor unit 10 when operating in a normal forward-blowing state.

FIG. 2A is a partial cross-sectional view of the air-conditioning indoor unit 10 when operating in a normal forward-blowing state. In FIG. 2A, when, e.g., the user has selected "forward blowing" via a remote controller or the like, the controller 40 turns the upward-downward airflow direction adjustment vane 31 to a position at which the inside surface 31*b* of the upward-downward airflow direction adjustment vane 31 is substantially horizontal. When the inside surface 31*b* of the upward-downward airflow direction adjustment vane 31 has an arcuate curved surface, the upward-downward airflow direction adjustment vane 31 is turned until the tangent at the front end E1 of the inside surface 31*b* is substantially horizontal. As a result, the blown air is in a state of being blown forward.

Figure 2B:
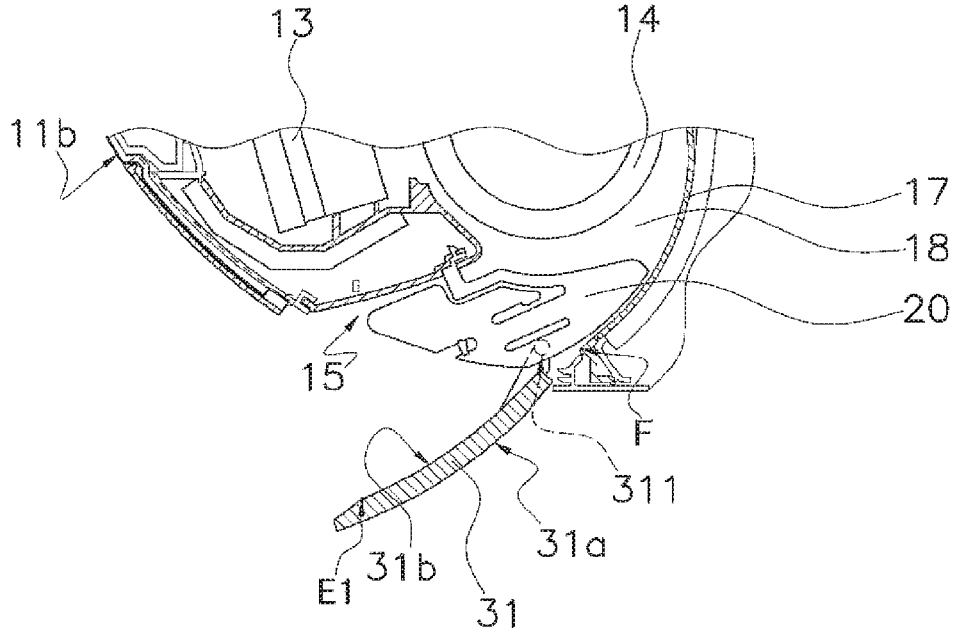
FIG. 2B is a partial cross-sectional view of the air-conditioning indoor unit 10 when operating in normal down-forward-blowing state.

FIG. 2B is a partial cross-sectional view of the air-conditioning indoor unit 10 when operating in normal down-forward-blowing state. In FIG. 2B, the user should select "normal down-forward blowing" when, e.g., desiring that the blown direction be lower than "normal forward blowing."

At this time, the controller 40 turns the upward-downward airflow direction adjustment vane 31 until the tangent at the front end E1 of the inside surface 31*b* of the upward-downward airflow direction adjustment vane 31 is slanted forward and downward from horizontal. As a result, the blown air is in a state of being blown forward and downward.

(2) Detailed Configuration (2-1) Front Surface Panel 11*b*

The front surface panel 11*b* extends in a gently arcuate curved surface from the upper front part of the main body casing 11 to the front edge of the lower horizontal plate 11*d*, as shown in FIG. 1.

(2-2) Blow-out Port 15

The blow-out port 15, formed in the lower part of the main body casing 11 as shown in FIG. 1, is a rectangular opening of which the long sides run in the transverse direction (the direction orthogonal to the image plane of FIG. 1). The lower end of the blow-out port 15 is tangent to the front edge of the lower horizontal plate 11*d*, and an imaginary plane connecting the lower and upper ends of the blow-out port 15 is inclined forward and upward.

(2-3) Scroll 17

The scroll 17 is a dividing wall curved so as to face the indoor fan 14, and is part of the bottom frame 16. The final end F of the scroll 17 reaches the proximity of the peripheral edge of the blow-out port 15. Air passing through the blow-out channel 18 progresses along the scroll 17 to be sent in a direction tangential to the final end F of the scroll 17. Therefore, if the blow-out port 15 did not have the upward-downward airflow direction adjustment vane 31, the airflow direction of blown air that is blown out from the blow-out port 15 would be roughly tangent to the final end F of the scroll 17.

(2-4) Upward-downward Airflow Direction Adjustment Vane 31

The upward-downward airflow direction adjustment vane 31 has an area sufficient to close the blow-out port 15. When the upward-downward airflow direction adjustment vane 31 has closed the blow-out port 15, the outside surface 31*a* thereof comes to be an outward-convex gently arcuate curved surface, so as to be an extension of the curved surface of the front surface panel 11*b*. The inside surface 31*b* (see FIGS. 2A and 2B) of the upward-downward airflow direction adjustment vane 31 also has an arcuate curved surface substantially parallel to the outer surface.

The upward-downward airflow direction adjustment vane 31 has a turning shaft 311 in the lower end. The turning shaft 311 is linked to the rotating shaft of a stepping motor (not shown) secured to the main body casing 11, in proximity to the lower end of the blow-out port 15.

The turning shaft 311 turning counterclockwise as seen in the front view of FIG. 1 causes the upper end of the upward-downward airflow direction adjustment vane 31 to activate so as to move away from the upper-end side of the blow-out port 15, opening the blow-out port 15. Conversely, the turning shaft 311 turning clockwise as seen in the front view of FIG. 1 causes the upper end of the upward-downward airflow direction adjustment vane 31 to activate so as to move toward the upper-end side of the blow-out port 15, closing the blow-out port 15.

When the upward-downward airflow direction adjustment vane 31 has opened the blow-out port 15, blown air that is blown out from the blow-out port 15 flows roughly along the inside surface 31*b* of the upward-downward airflow direction adjustment vane 31. Specifically, blown air that is blown out roughly along a direction tangential to the final end F of the scroll 17 is altered slightly upward in airflow direction by the upward-downward airflow direction adjustment vane 31.

(2-5) Vertical Airflow Direction Adjustment Vane 20

Figure 3:
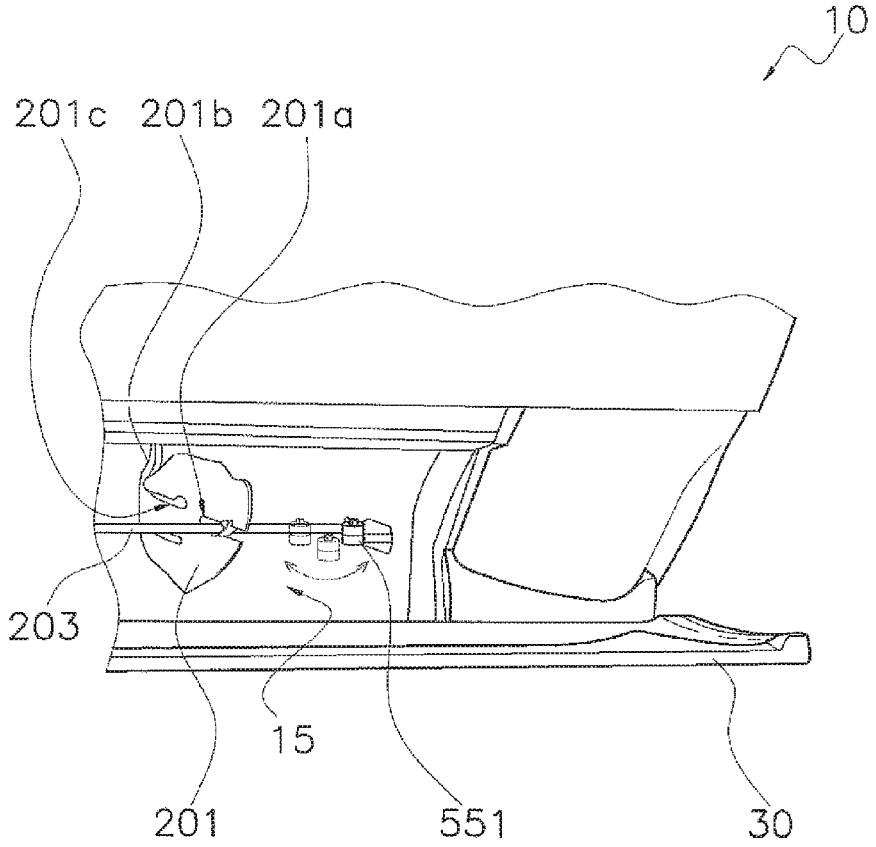
FIG. 3 is a perspective view of a vane piece 201 and the surrounding area thereof.

FIG. 3 is a perspective view of a vane piece 201 and the surrounding area thereof. In FIG. 3, a vertical airflow direction adjustment vane 20 has a plurality of vane pieces 201 and a linking rod 203 for lining the plurality of vane pieces 201. The vertical airflow direction adjustment vane 20 is also disposed nearer to the indoor fan 14 than the upward-downward airflow direction adjustment vane 31 within the blow-out channel 18.

The plurality of vane pieces 201 swing left and right from being vertical relative to the longitudinal direction of the blow-out port 15, due to the linking rod 203 moving reciprocally along the longitudinal direction. The linking rod 203 is reciprocally driven by a motor (not shown).

The vane pieces 201 are plate pieces that gradually increase in area from the indoor fan 14 side of the blow-out channel 18 toward the blow-out port 15 side. In each vane piece, a slit hole 201*a* for inserting the linking rod 203 is formed in the blow-out port 15 side, and a support part 201*b* supported inside the main body casing 11 is formed in the end on the indoor fan 14 side. Also formed in each vane piece 201 are two slits 201*c* extending from the middle toward the support part 201*b*.

The plurality of vane pieces 201 swing left and right from being vertical relative to the longitudinal direction of the main body casing 11, due to the linking rod 203 moving reciprocally along the longitudinal direction of the blow-out port 15. The linking rod 203 is moved reciprocally by a drive unit 70 (see FIGS. 4A to 4C).

(2-6) Drive Unit 70

Figure 4A:
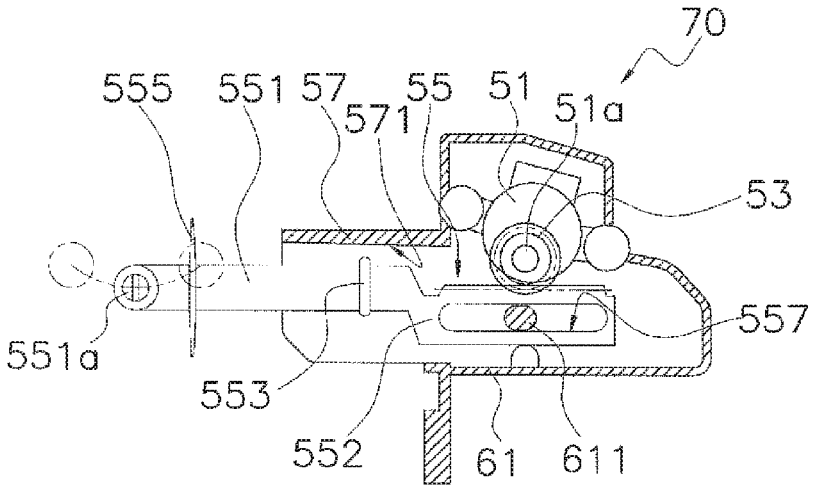
FIG. 4A is a cross-sectional view of a drive unit 70 according to an embodiment of the present invention when the drive unit 70 is in a first state.
Figure 4B:
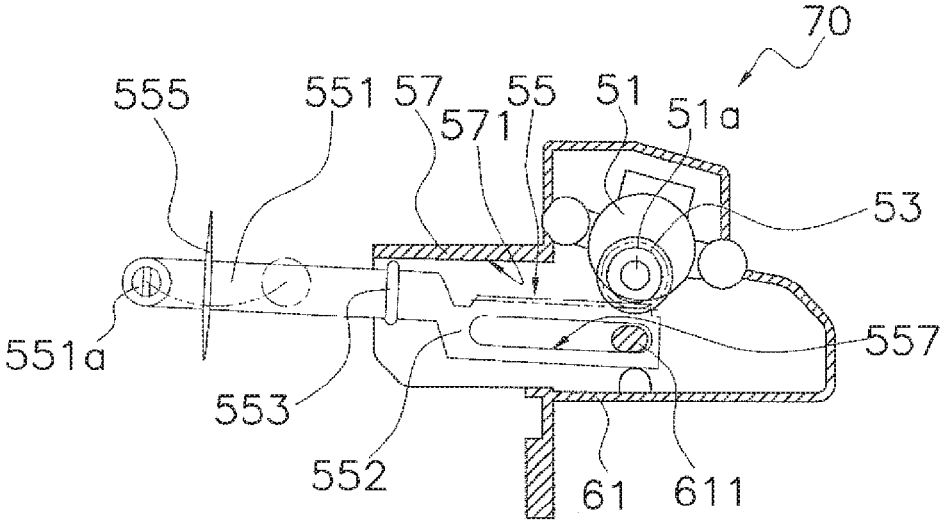
FIG. 4B is a cross-sectional view of the drive unit 70 in a second state.
Figure 4C:
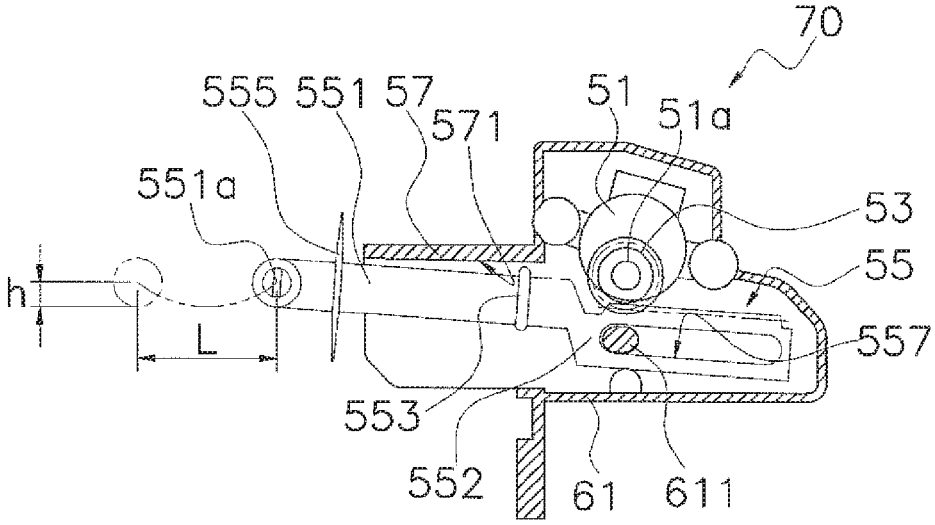
FIG. 4C is a cross-sectional view of the drive unit 70 in a third state.

FIG. 4A is a cross-sectional view of the drive unit 70 according to an embodiment of the present invention when the drive unit 70 is in a first state. FIG. 4B is a cross-sectional view of the drive unit 70 in a second state. Furthermore, FIG. 4C is a cross-sectional view of the drive unit 70 in a third state.

In FIG. 4A, the drive unit 70 includes a motor 51, a pinion 53, a rack 55, a guide 57, and a gearbox 61.

In FIGS. 4A to 4B, the second state refers to a state in which an arm part 551 is furthest extended, the third state refers to a state in which the arm part 551 is furthest retracted, and the first state refers to an intermediate state between the second and third states.

(2-6-1) Motor 51

The motor 51 is a stepping motor. The motor 51 has a rotating shaft 51*a* for outputting an amount of rotation corresponding to the number of inputted pulses, (2-6-2) Pinion 53

The pinion 53 is a small gear secured to the rotating shaft 51*a* of the motor 51. The pinion 53 outputs the same rotation amount as the rotation amount of the rotating shaft 51*a* in the same direction as the rotating direction of the rotating shaft 51*a* of the motor 51.

(2-6-3) Rack 55

The rack 55 has a rack part 552 and an arm part 551. The rack part 552 meshes with the pinion 53. The rack part 552 has a guide groove 557 provided to an area on the side opposite the pinion 53 across the portion meshing with the pinion 53. In the guide groove 557, a gap between the two opposing end surfaces in the longitudinal direction is greater than the distance over which the rack 55 moves.

A convex fastener 551*a* is formed at the distal end of the arm part 551. The convex fastener 551*a* is linked to the linking rod 203 by being inserted and snap-fitted into a linking hole provided in the end of the linking rod 203.

The rack 55 has a flange 555 from the distal end of the arm part 551 to the guide 57, the flange protruding from the arm part 551 so as to expand the cross-sectional area thereof.

Furthermore, the rack 55 has a protuberance 553 protruding toward the inner surface of the guide ∂in the portion of the arm part 551 that is guided into the guide 57.

(2-6-4)

The guide 57, which is composed of a tube part 571 through which the rack 55 passes, guides the rack 55 so that the arm part 551 can travel in a curved path.

The flange 555 of the rack 55 is positioned between the distal end of the arm part 551 and the portion accommodated in the tube part 571, and the area of the flange 555 is set larger than the opening area of the tube part 571. Therefore, when the drive mechanism is disposed in a portion through which conditioned air flows, cold air would enter the tube part 571 except that entry of cold air into the tube part 571 is hindered by the presence of the flange 555, and situations such as condensation on the inner side of the tube part 571 are therefore prevented.

The protuberance 553 of the rack 55 also protrudes toward the inner surface of the tube part 571 from the portion accommodated in the tube part 571.

(2-6-5) Gearbox 61

The gearbox 61 accommodates the meshing portion of the rack 55 and the pinion 53. The guide 57 has the tube part 571 which is communicated with the interior of the gearbox 61, and through which the rack 55 passes.

The gearbox 61 has a rib 611. The rib 611 enters the guide groove 557 of the rack 55 when the meshing portion of the rack 55 and the pinion 53 has been accommodated. In a normal rack and pinion mechanism, the movement distance of the rack is adjusted by controlling the rotation amount of the pinion, but mechanical restrictions are needed in order to prevent mishaps such as the rack falling out due to the motor overrunning. In the present embodiment, the rib 611 on the gearbox 61 side enters the guide groove 557 of the rack part 552 in the unfortunate event that the motor 51 overruns, and the rib 611 and the end of the guide groove 557 therefore come into contact, preventing the rack 55 from falling out.

(3) Actions of Drive Unit 70

At the start of an operation, e.g., an air-cooling operation of the air-conditioning indoor unit 10 equipped with the drive unit 70, the counterclockwise turning of the turning shaft 311 of the upward-downward airflow direction adjustment vane 31 causes the upper end of the upward-downward airflow direction adjustment vane 31 to actuate so as to move away from the upper-end side of the blow-out port 15, opening the blow-out port 15, as shown in FIG. 2A.

When the user has selected "normal forward blowing" via a remote controller or the like, the controller 40 causes the upward-downward airflow direction adjustment vane 31 to turn to a position where the inside surface 31*b* of the upward-downward airflow direction adjustment vane 31 is substantially horizontal. As a result, conditioned air is blown out substantially horizontally from the blow-out port 15.

The controller 40 causes the vane pieces 201 of the vertical airflow direction adjustment vane 20 to swing to the left and right, causing the blown air to be blown alternately left and right. The controller 40 causes the rotating shaft 51*a* of the motor 51 to rotate alternately clockwise and counterclockwise, in order to reciprocally move the linking rod 203 along the longitudinal direction of the blow-out port 15.

Because the rotation amount of the rotating shaft 51*a* is transmitted to the rack 55 as the rotation amount of the pinion 53, the linking rod 203, linked to the distal end of the arm part 551 of the rack 55, moves reciprocally in the longitudinal direction. As a result, the vane pieces 201 of the vertical airflow direction adjustment vane 20 swing left and right.

The linking rod 203 does not travel in simple reciprocating motion, but moves in reciprocating motion while the distal end of the arm part 551 travels in an arcuate path as shown in FIG. 3. This is because when the vane pieces 201 of the vertical airflow direction adjustment vane 20 swing left and right, the linking rod 203 moves so as to be pushed out to the front of the blow-out port 15, and the linking rod 203 therefore travels unhindered in an arcuate path.

In conventional practice, a rack and pinion mechanism is utilized on the premise that the rack is made to reciprocate linearly; therefore, the rack and pinion does not have the function of making the rack swing.

However, in the drive mechanism 70, the swinging motion of the rack can be directly extracted from the rack and pinion because the arm part 551 travels in a curved path (an arcuate path), due to the guide 57 allowing the arm part 551 of the rack 55 to oscillate within a predetermined range in a direction intersecting the longitudinal direction of the arm part.

As shown in FIG. 4C, the oscillating range of the arm part 551 in a direction intersecting the longitudinal direction, represented by the ratio (h/L) of the displacement h of the distal end of the arm part 551 in a direction intersecting the longitudinal direction, relative to the movement distance L of the arm part 551 in the longitudinal direction, is set within the range 0.15 to 0.25, whereby the radius of the arc traveled by the distal end of the arm part 551 is 100 mm or less.

The factor that allows the swinging motion of the rack 55 to be extracted from the rack and pinion mechanism of the drive unit 70 is that the clearance between the arm part 551 of the rack 55 and the tube part 571 of the guide 57 for guiding the arm part 551 is expanded to an extent that is normally not set.

Normally, in order for the rack 55 to be moved linearly, the clearance with the member guiding the rack is used as much as it can be without any obstacles to the rack's movement, but in the present embodiment, the opposite of the common practice is adopted to enable the distal end of the arm part 551 to turn about the proximity of the meshing point of the rack 55 and the pinion 53, and to enable the distal end to swing in accordance with this clearance when the rack 55 is reciprocating.

The clearance between the arm part 551 and the tube part 571 can be varied by adjusting the height of the protuberance 553 of the rack 55. In other words, the clearance between the protuberance 553 and the inner surface of the tube part 571 determines the range that the arm part 551 can oscillate in the direction intersecting the longitudinal direction, and the necessary oscillation range can therefore be achieved by adjusting this clearance.

As described above, the drive unit 70 allows swinging motion to be directly extracted from the rack and pinion mechanism by causing the rack 55 to travel in a curved path, and the conventional member for converting the linear motion of the rack to swinging motion can therefore be omitted.

(4) Characteristics (4-1)

In the drive unit 70, a rack and pinion mechanism converts rotational motion to reciprocating linear motion, where swinging motion is extracted directly from the rack 55 and pinion 53 by making the rack travel in a curved path, and the conventional member for converting the linear motion of the rack to swinging motion can therefore be omitted. Because the swinging amount of the vane pieces 201 of the vertical airflow direction adjustment vane 20 can be adjusted by the rotating amount of the pinion 53, the motor torque can be reduced more than with a configuration in which the swinging amount is adjusted by the distance "from the motor shaft to the linking point of the first link and the second link," as has been done in the past.

(4-2)

The swinging motion of the rack 55 can be directly extracted from the rack 55 and pinion 53 because the arm part 551 travels in a curved path (an arcuate path), due to the guide 57 allowing the arm part, 551 of the rack 55 to oscillate within a predetermined range in a direction intersecting the longitudinal direction of the arm part 551. Therefore, fewer components are required than in a conventional link structure.

(4-3)

The clearance between the protuberance 553 and the inner surface of the tube part 571 determines the range that the arm part 551 of the rack 55 can oscillate in the direction intersecting the longitudinal direction, and the necessary oscillation range can therefore be achieved by adjusting this clearance.

(4-4)

Because entry of cold air into the tube part 571 is hindered by the presence of the flange 555, situations such as condensation on the inner side of the tube part 571 are prevented.

(4-5)

The rib 611 on the gearbox 61 side enters the guide groove 557 of the rack 55 in the unfortunate event that the motor 51 overruns, and the rib 611 and the end of the guide groove 557 therefore come into contact, preventing the rack 55 from falling out.

What is claimed is:

1. A drive mechanism configured to drive a movable member of an air conditioner, the drive mechanism comprising:

a motor;

a pinion secured to a rotating shaft of the motor;

a rack having a driven portion directly or indirectly linked to the movable member, the rack meshing with the pinion, the driven potion having an elongated shape; and a guide arranged to guide the rack so that the driven portion can travel in a curved path, the guide having a tube part through which the rack passes along a longitudinal direction of the driven potion, and the rack having a protuberance that protrudes from a portion accommodated in the tube part toward an inner surface of the tube part.

2. The drive mechanism according to claim 1, wherein the guide causes the driven portion to travel in a curved path by allowing the driven portion to oscillate within a predetermined range in a direction intersecting a longitudinal direction of the driven portion.

3. The drive mechanism according to claim 1, wherein the curved path is an arcuate path.

4. The drive mechanism according to claim 3, wherein a radius of an arc traveled by the distal end of the driven portion is 100 mm or less.

5. The drive mechanism according to claim 1, wherein a ratio of a displacement of the distal end of the driven portion in a direction intersecting a longitudinal direction relative to a movement distance of the driven portion in the longitudinal direction, is 0.15 to 0.25.

6. A drive mechanism configured to drive a movable member of an air conditioner, the drive mechanism comprising:

a motor;

a pinion secured to a rotating shaft of the motor;

a rack having a driven portion directly or indirectly linked to the movable member, the rack meshing with the pinion, the driven potion having an elongated shape; and a guide arranged to guide the rack so that the driven portion can travel in a curved path, the guide having a tube part through which the rack passes a longitudinal direction of the driven potion, and the rack having a flange from a distal end of the driven portion to a portion accommodated in the tube part, the flange being larger than an opening area of the tube part.

7. The drive mechanism according to claim 6, wherein the guide causes the driven portion to travel in a curved path by allowing the driven portion to oscillate within a predetermined range in a direction intersecting a longitudinal direction of the driven portion.

8. The drive mechanism according to claim 6, wherein the curved path is an arcuate path.

9. The drive mechanism according to claim 8, wherein a radius of an arc traveled by the distal end of the driven portion is 100 mm or less.

10. The drive mechanism according to claim 6, wherein a ratio of a displacement of the distal end of the driven portion in a direction intersecting a longitudinal direction relative to a movement distance of the driven portion in the longitudinal direction, is 0.15 to 0.25.

11. A drive mechanism configured to drive a movable member of an air conditioner, the drive mechanism comprising:

a motor;

a pinion secured to a rotating shaft of the motor;

a rack having a driven portion directly or indirectly linked to the movable member, the rack meshing with the pinion; and a guide arranged to guide the rack so that the driven portion can travel in a curved path;

a gearbox arranged to accommodate a meshing portion of the rack and pinion, the guide having a tube part communicating with an interior of the gear box, the rack passing through the tube part, the rack further having, in an area on a side opposite the pinion across a portion meshing with the pinion, a guide groove in which a gap between opposing end surfaces is greater than a movement distance of the rack, and the gearbox having a rib that enters the guide groove of the rack when the meshing portion of the rack and pinion is accommodated.

12. The drive mechanism according to claim 11, wherein the guide causes the driven portion to travel in a curved path by allowing the driven portion to oscillate within a predetermined range in a direction intersecting a longitudinal direction of the driven portion.

13. The drive mechanism according to claim 11, wherein the curved path is an arcuate path.

14. The drive mechanism according to claim 13, wherein a radius of an arc traveled by the distal end of the driven portion is 100 mm or less.

15. The drive mechanism according to claim 11, wherein a ratio of a displacement of the distal end of the driven portion in a direction intersecting a longitudinal direction relative to a movement distance of the driven portion in the longitudinal direction, is 0.15 to 0.25.

* * * * *